US005377828A

United States Patent [19]

Jaroshewich

[11] Patent Number: 5,377,828

[45] Date of Patent: Jan. 3, 1995

[54] HOCKEY PUCK DISPLAY APPARATUS

[76] Inventor: Daniel P. Jaroshewich, 2109 Wattles, Troy, Mich. 48098

[21] Appl. No.: 119,499

[22] Filed: Sep. 10, 1993

[51] Int. Cl.[6] ..... B65D 85/20; B65D 73/00; A97F 7/00

[52] U.S. Cl. ..... 206/315.1; 40/124.4; 206/477; 206/482; 206/486; 206/488; 211/13; 211/89

[58] Field of Search ..... 40/160, 124.4, 323; 206/477, 482, 486, 487, 488, 489, 0.8–0.84, 315.1; 211/13, 89, 41; 273/57.2

[56] References Cited

U.S. PATENT DOCUMENTS

| | | | |
|---|---|---|---|
| 1,436,250 | 11/1922 | Harsh | 206/477 |
| 1,842,118 | 1/1932 | Resnik et al. | 211/41 |
| 2,139,150 | 12/1938 | Curtis et al. | 206/0.84 |
| 2,258,535 | 10/1941 | Buranelli | 206/0.84 |
| 3,473,247 | 10/1969 | La Favor et al. | 40/160 X |
| 3,822,782 | 7/1974 | Ringle et al. | 206/0.83 |
| 3,950,024 | 4/1976 | Martin | 206/315.1 X |
| 4,351,505 | 9/1982 | Wichersham | 211/89 X |

FOREIGN PATENT DOCUMENTS

| | | | |
|---|---|---|---|
| 13242 | of 1902 | United Kingdom | 206/477 |

*Primary Examiner*—Bryon P. Gehman
*Attorney, Agent, or Firm*—Harness, Dickey & Pierce

[57] ABSTRACT

A device for displaying hockey pucks has a board member including at least one holding member for retaining a hockey puck on the board. Also, a second holding member for maintaining a hockey card on the board member may be included. The hockey pucks are positioned in the holding men,hers such that the display provides an overall aesthetic appearance enabling collectors to display their hockey puck collection.

7 Claims, 1 Drawing Sheet

Fig-1
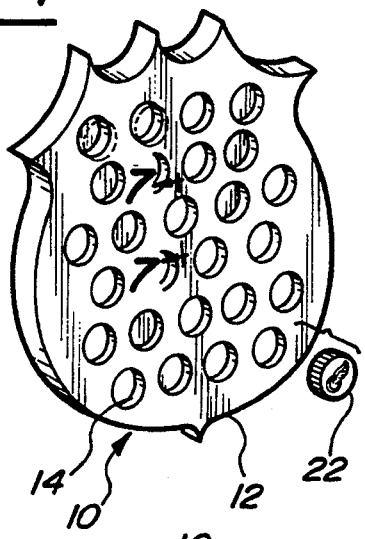
Fig-2
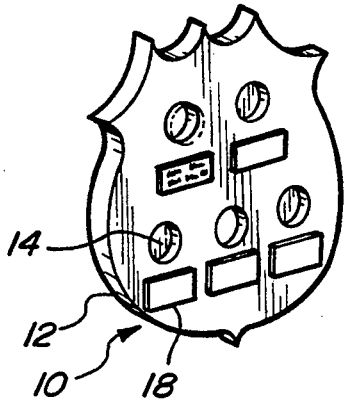
Fig-3
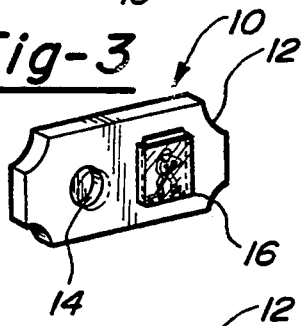
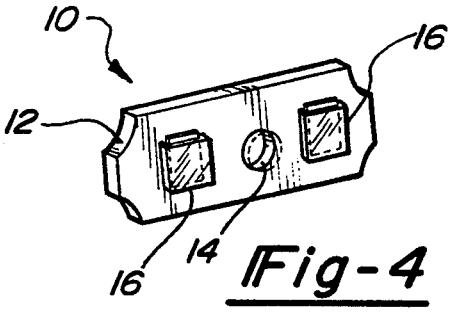
Fig-4
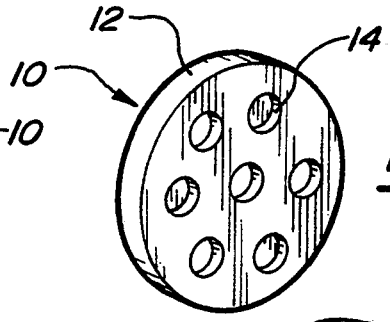
Fig-6
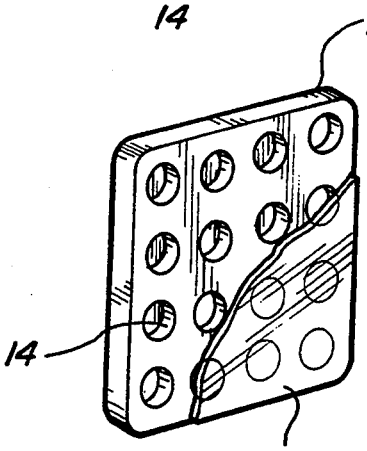
Fig-5
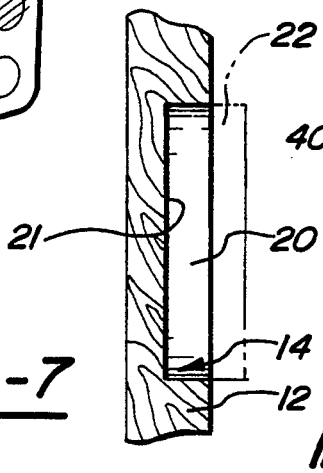
Fig-7
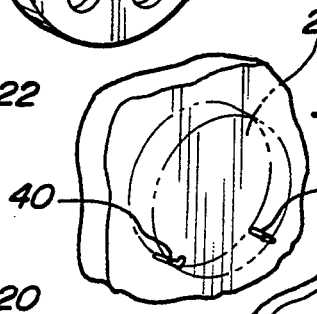
Fig-8
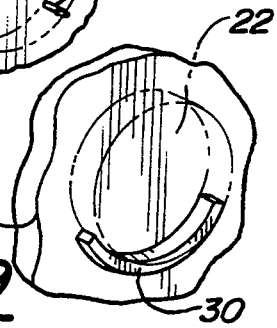
Fig-9

HOCKEY PUCK DISPLAY APPARATUS

BACKGROUND OF THE INVENTION

The present invention relates to a display apparatus and, more particularly, to a device for displaying hockey pucks.

Collectors of various types of sports memorabilia or the like are faced with the difficulty of displaying their collections. Several types of display devices are available from picture frames to plexiglass boxes, however, these devices utilize a substantial amount of display space and are somewhat cumbersome. It would be desirable to have a display device which enables a neat display of one or several items.

SUMMARY OF THE INVENTION

Thus, it is an object of the present invention to provide a display device which neatly displays hockey pucks. The device may include, along with the display of a hockey puck, a hockey card of the collector's favorite player(s). The invention also provides for the display of several pucks at one time. The pucks may be displayed via division, conference, or as the entire league.

The display device provides the collector with a unique apparatus for displaying his hockey pucks. The invention includes holding members to maintain the hockey pucks onto a display board. The invention may include a second holding member for displaying a card of a favorite player.

From the following detailed description taken in conjunction with the accompanying drawings and subjoined claims, other objects and advantages of the present invention will become apparent to those skilled in the art.

BRIEF DESCRIPTION OF THE DRAWINGS

FIGS. 1 through 6 illustrate various configurations of the display device in accordance with the present invention.

FIG. 7 is a cross section view through a portion of FIG. 1 along line 7—7 thereof.

FIG. 8 illustrates a partial perspective view of a second embodiment of the present invention.

FIG. 9 illustrates a partial perspective view of an additional embodiment of the present invention.

DETAILED DESCRIPTION OF THE PREFERRED EMBODIMENTS

Turning to the figures, particularly FIGS. 1 through 6, several hockey puck display devices are illustrated and designated with the reference numeral 10. Generally, the displays include a board member 12 having two opposed substantially planar surfaces, each surface peripherally defined by a completely free edge, a puck holding member 14 and optional card holding members 16. Also, an optional transparent cover 17 may be included as illustrated in FIG. 5.

The board member 12 may have various types of configurations. Shield, rectangular, square or circular configurations are preferred. However, the board member can have any desired configuration. Also, the board may include various types of indicia, coloring or the like. Further, the board may include identification plates 18 like those illustrated in FIG. 2. The identification plates may identify a specific team or a player on a particular team.

The holding member 14 is generally a countersunk bore or through bore in the backing member 12. The bore 14 has a desired diameter such that a hockey puck fits closely within the bore. The bores may vary in number from one to the desired number of teams in the league, division, conference, individual team or the like. Thus, depending upon the number of pucks which a collector cares to exhibit, that number of bores would be included on the backing member 12. The bores provide a surface 20 which seats the cylindrical portion of the puck 22 and a surface 21 which abuts the planar portion of the puck, as best seen in FIG. 7. The pucks may be positioned on the board such that they are flush with the backing member 12 or they may extend a desired distance enabling easy removal of the puck from the backing member 12.

Also, as seen in FIGS. 3 and 4, the board may include a second holding member 16. The second holding member 16 generally is a rectangular transparent card holder. The transparent card holder 16 may be permanently secured to the board member or it may be removable. Hook and loop fasteners, corner supports or the like may be utilized to enable removability of the card holder from the board.

Turning to FIGS. 8 and 9, alternative embodiments are shown. FIG. 8 illustrates a pair of pins 40 positioned a desired distance from one another. The pins 40 enable the puck to be positioned within the pins 40 such that the cylindrical portion rests against the pins. The pins may be straight or may include a turned portion providing an overall L shape of the pin.

In FIG. 9, an arcuate member 30 having a radius slightly larger than the radius of a hockey puck is illustrated positioned on a board. These arcuate members 30 would be positioned on the board at the bottom of where the puck is to be positioned. The puck would fit into the arcuate members such that the counter bore may or may not be used. The arcuate members 30 may be formed from plastic, wood or the like materials, providing an arc or a rest for receiving the cylindrical portion of the puck 22. Thus, the puck would seat in the arcuate member enabling display of the puck.

While the above detailed description describes the preferred embodiment of the present invention, the invention is susceptible to modification, variation, and alteration without deviating from the scope and fair meaning of the subjoined claims.

What is claimed is:

1. An ornamental hockey puck display apparatus comprising:

a board member, said board member having two opposed substantially planar surfaces, each surface peripherally defined by a completely free edge, one of said surfaces providing a backing;

at least one hockey puck holding member associated with said one surface of said board member, each holding member having an arcuate surface portion engaging a cylindrical side surface of a hockey puck for supporting the cylindrical surface of the hockey puck, and displaying the hockey puck such that a flat portion of the hockey puck is in a plane parallel to said board member.

2. The hockey puck display apparatus according to claim 1 wherein a plurality of holding members are associated with said board member.

3. The hockey puck display apparatus according to claim 1 wherein said holding member is a counter sink in said board member.

4. The hockey puck display apparatus according to claim 1 including a second holding member associated with said board member, said second holding member for holding a playing card.

5. The hockey puck display apparatus according to claim 4 wherein said second holding member is transparent and may be removably secured to said backing member.

6. The hockey puck display apparatus according to claim 1 wherein said backing member has an overall shape like a shield.

7. The hockey puck display apparatus according to claim 1 wherein said backing member has an overall rectangular or circular configuration.

* * * * *

UNITED STATES PATENT AND TRADEMARK OFFICE

CERTIFICATE OF CORRECTION

PATENT NO. : 5,377,828

DATED : January 3, 1995

INVENTOR(S) : Daniel P. Jaroshewich

It is certified that error appears in the above-indentified patent and that said Letters Patent is hereby corrected as shown below:

In the Abstract, line 6, "men,hers" should be --members--

Signed and Sealed this

Twenty-ninth Day of August, 1995

*Attest:*

Bruce Lehman

BRUCE LEHMAN

*Attesting Officer*

*Commissioner of Patents and Trademarks*